US007699765B2

(12) United States Patent
Biese et al.

(10) Patent No.: US 7,699,765 B2
(45) Date of Patent: Apr. 20, 2010

(54) METHOD OF MAKING A BAG USING A VISION SYSTEM ARRANGEMENT

(75) Inventors: John Biese, Hortonville, WI (US); Jim Smits, Green Bay, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 2 days.

(21) Appl. No.: 12/061,036

(22) Filed: Apr. 2, 2008

(65) Prior Publication Data

US 2009/0252440 A1 Oct. 8, 2009

(51) Int. Cl.
*B31B 49/04* (2006.01)
*B31B 1/14* (2006.01)

(52) U.S. Cl. ..... 493/21; 493/22; 493/194; 493/199; 493/238

(58) Field of Classification Search ..... 493/11, 493/21, 22, 194–197, 199–202, 238
See application file for complete search history.

(56) References Cited

U.S. PATENT DOCUMENTS 2,936,815 A * 5/1960 Schjeldahl et al. ..... 493/21
5,292,299 A 3/1994 Anderson et al.
5,447,486 A 9/1995 Anderson et al.
5,470,300 A 11/1995 Terranova
5,488,480 A 1/1996 Saindon et al.
5,660,674 A 8/1997 Saindon et al.
5,777,879 A 7/1998 Sommerfeldt
5,833,107 A * 11/1998 Terranova et al. ..... 493/11
5,861,078 A 1/1999 Huben et al.
6,024,683 A * 2/2000 Wilkes ..... 493/196

(Continued)

FOREIGN PATENT DOCUMENTS

JP 10296880 11/1998

(Continued)

*Primary Examiner*—Stephen F Gerrity
(74) *Attorney, Agent, or Firm*—Merchant & Gould P.C.

(57) ABSTRACT

A system and method for making bags in a continuous in-line process includes a central processing unit and a camera oriented to take an image of a bag based on a triggering signal. The camera provides an image to the central processing unit. The central processing unit is programmed to process the image and calculate a timing signal based on the image. A cylindrical rotatable drum having at least one seal bar provides a triggering signal to the central processing unit, to trigger when the camera should take the image. A perforation knife is controlled by a servo drive. The perforation knife is downstream of the drum. The servo drive receives the timing signal for activating the perforation knife from the central processing unit. The CPU uses the image and based on the distance between the seal region and the perforated line, counts pixels to result in an actual pixel count. The CPU then calculates a pixel count error by subtracting the actual pixel count from a predetermined pixel count setpoint. This information is then used by the CPU to either advance or retard the perforated knife in its perforation step. This results in a bag having a shorter skirt length, which reduces waste and cost. In another embodiment, the image taken is of the seal region only, and based on the image, the CPU either advances or retards the perforation knife in the perforation step, downstream of the point in which the image was taken.

17 Claims, 6 Drawing Sheets

U.S. PATENT DOCUMENTS

| | | | | |
|---|---|---|---|---|
| 6,106,448 | A * | 8/2000 | Obara et al. | 493/11 |
| 6,354,984 | B1 * | 3/2002 | Hensley et al. | 493/11 |
| 6,416,453 | B1 * | 7/2002 | Simonetti et al. | 493/22 |
| 6,792,807 | B2 | 9/2004 | Binder et al. | |
| 7,311,647 | B2 * | 12/2007 | Delisle et al. | 493/10 |
| 2004/0005974 | A1 * | 1/2004 | Lamping et al. | 493/10 |
| 2007/0179035 | A1 | 8/2007 | Selle et al. | |
| 2007/0179036 | A1 | 8/2007 | Selle et al. | |
| 2007/0184957 | A1 * | 8/2007 | Trezzi | 493/194 |
| 2007/0237201 | A1 * | 10/2007 | Ignatowicz | 374/7 |
| 2007/0293382 | A1 | 12/2007 | Sauder et al. | |

FOREIGN PATENT DOCUMENTS

| | | |
|---|---|---|
| JP | 11079112 | 3/1999 |

* cited by examiner

METHOD OF MAKING A BAG USING A VISION SYSTEM ARRANGEMENT

TECHNICAL FIELD

This disclosure concerns disposer bags. In particular, this disclosure concerns a system and method for making a disposer bag using a vision system.

BACKGROUND

A disposer bag is a bag typically made from a polymeric material which can be used for lining trash cans, or for holding groceries, or for any uses that need an inexpensive flexible bag.

These types of bags are often sold to consumers in a continuous roll, in which individual bags are separated from the remaining portion of the roll by tearing along a perforation line. The perforation line is placed adjacent to a seal, which can be either a bottom seal or a side seal. The amount of material between the perforation line and the seal is referred to as the "skirt." The skirt is usually wasted material. Improvements in methods and arrangements for manufacturing bags are desirable.

SUMMARY

A method of making a bag in a continuous in-line process includes continuously advancing a web including a first layer on top of a second layer of polymeric film along a processing line. While the web is advancing, an image is taken of a first seal region and a first perforated line. Using the image, pixels are counted between an edge of the first seal region and an edge of the first perforated line to result in an actual pixel count. A pixel count error is calculated by subtracting the actual pixel count from a predetermined pixel count setpoint. A second perforated line is applied to the web upstream of the first seal region and first perforated line based on the pixel count error.

Preferably, the step of applying a second line includes determining the polarity of the pixel count error and advancing or retarding the step of applying a second perforated line based on the polarity.

Preferably, the step of advancing or retarding the step of applying a second perforated line based on the polarity is based on a proportion to a magnitude of the pixel count error.

In another aspect, an arrangement to make bags in an in-line process includes a central processing unit (CPU); a camera oriented to take an image of a bag in the in-line process based on a triggering signal received from the central processing unit and provide an image to the central processing unit; a cylindrical rotatable drum having at least one seal bar; and a perforation knife controlled by a servo drive. The central processing unit is programmed to process the image and calculate a timing signal based on the image. The drum provides the triggering signal to the central processing unit. The servo drive receives the timing signal for activating the perforation knife from the central processing unit.

Preferably, the arrangement also includes a light source, which can be a strobe lamp, receiving the triggering signal from the central processing unit and activating based on the triggering signal.

In another aspect, a process for making a bag in a continuous in-line process includes continuously advancing a web including a first layer on top of a second layer of polymeric film along a processing line, and while the web is advancing: (i) taking an image of a first seal region; (ii) using the image, counting pixels from an edge of the first seal region to result in an actual pixel count; (iii) calculating a pixel count error by subtracting the actual pixel count from a predetermined pixel count setpoint; and (iv) applying a perforated line to the web based on the pixel count error.

In this method, the step of applying the perforated line includes determining the polarity of the pixel count error and advancing or retarding the step of applying a perforated line based on the polarity. The size of the advance or retard will be proportional to the magnitude of the pixel count error.

In some implementations, the step of taking an image of a first seal region includes taking an image of a first seal region and a first perforated line; the step of counting pixels includes counting pixels from the first seal region edge to an edge of the first perforation line to result in the actual pixel count; and the step of applying a perforated line to the web based on the pixel count error includes applying a second perforated line to the web upstream of the first seal region.

In another embodiment, the step of taking an image of a first seal region includes taking an image of a first seal region devoid of a perforated line; the step of counting pixels includes counting pixels from a leading edge of the first seal region edge to result in the actual pixel count; and the step of applying a perforated line to the web based on the pixel count error includes applying a perforated line to the web downstream of the first seal region.

DETAILED DESCRIPTION

A. Some Problems with Existing Processes and Arrangements

As mentioned above, the bag skirt is defined as the region between the seal area and the perforation line. The skirt is primarily wasted material. Therefore, the inventors have recognized that if the skirt is shorter, this will save on material, which will contribute to reducing waste and cost. Inventors have recognized that if the process can be controlled so that the perforation line is placed within an optimal range of the edge of the seal, then the skirt length can be minimized, saving money and material.

B. The System of FIGS. 1-6

Figure 1:
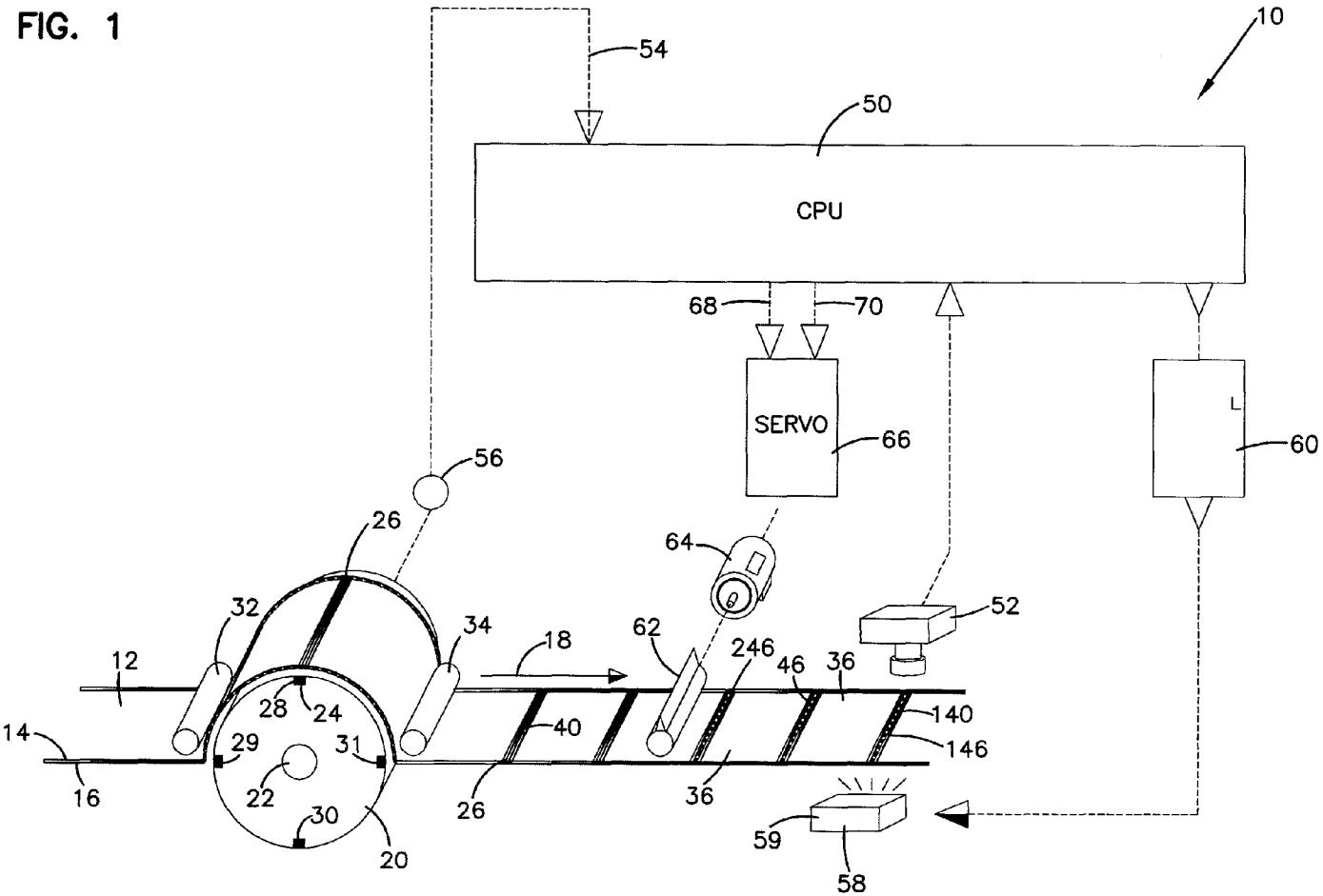
FIG. 1 is a schematic diagram of an arrangement to make bags in a continuous in-line process in accordance with principles of this disclosure.

FIG. 1 shows a bag making system or arrangement at 10. The arrangement 10 is part of an automated, continuous in-line process, which starts with a web of film and results in a plurality of individual bags that are connected to an adjacent bag by only a perforation line. Typically, these are sold to a consumer in a roll, and when the consumer needs another bag, the consumer tears along the perforated line to separate one individual bag from the rest of the bags on the roll.

In FIG. 1, a web 12 of a polymeric film is continuously advanced. This web 12 will include a first layer 14 on top of a second layer 16. In some applications, the layers 14 and 16 are part of a single continuous tube resulting from an extrusion process. In other applications, the layers 14 and 16 are separate and distinct layers, which themselves may have resulted from a blown extrusion process. In some applications, the first and second layers 12 and 16 are connected by fold lines or in other places. The polymeric material can include various plastics including polyethylene, either high or low density.

Figure 6:
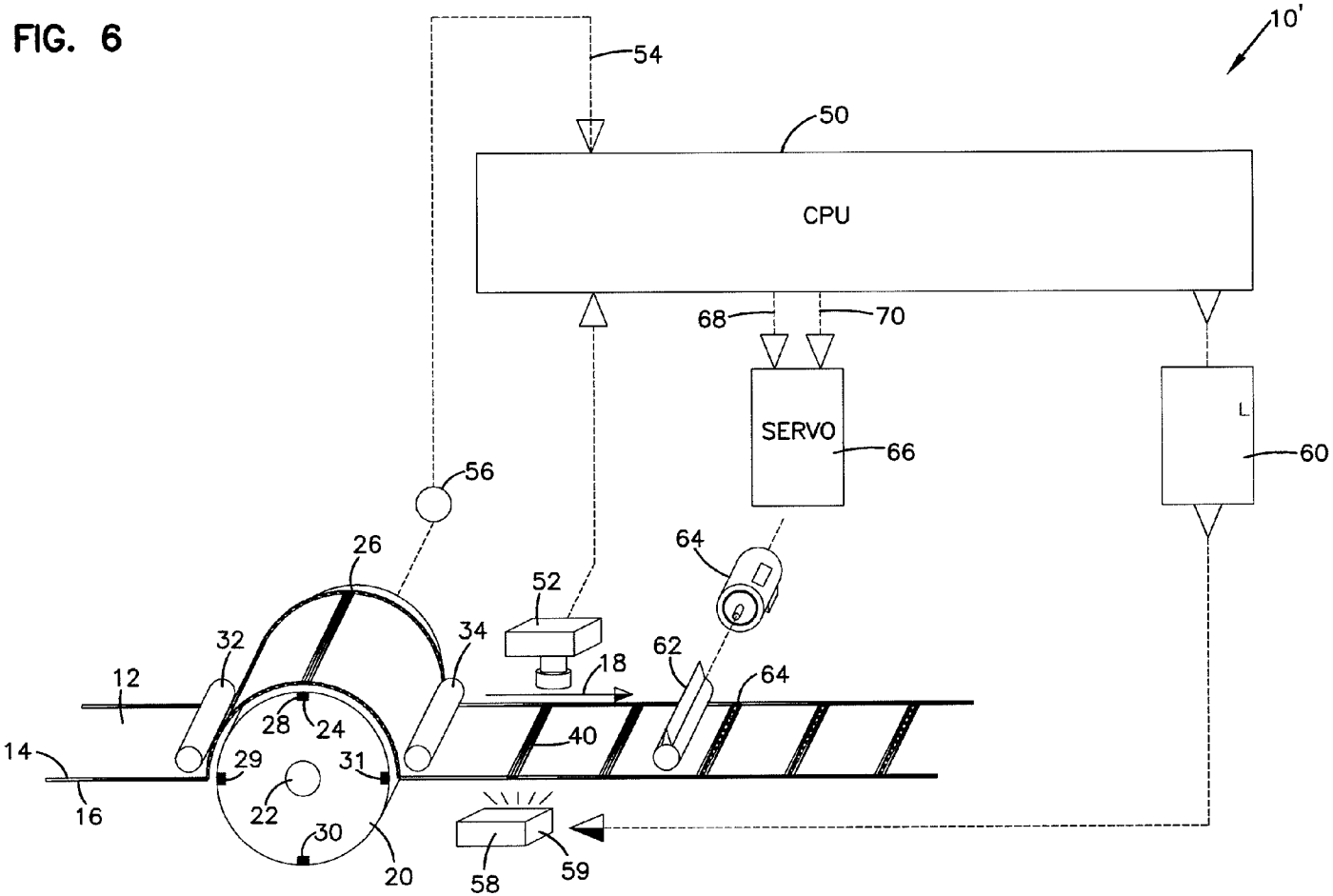
FIG. 6 is a schematic diagram, similar to FIG. 1, but depicting a variation of the arrangement to make bags in a continuous in-line process in accordance with principles of this disclosure.

The web is continuously advanced through conventional processing methods such as conveyers, rollers, etc. In FIGS. 1 and 6, the web 12 is shown advancing in the direction of arrow 18 from left to right. The web 12 is advanced over a cylindrical rotatable drum 20. The drum 20 is driven to rotate about a center axis 22. It holds at least one seal bar 24. When the web 12 contacts the seal bar 24, a heat seal 26 is made between the first layer 14 and second layer 16 of the web 12. In the embodiment shown, the drum 20 has a plurality of seal bars 24 depicted as four seal bars at 28, 29, 30, and 31. The seal bars 28-31 are spaced 90 degrees apart. The number of seal bars used can vary depending upon the diameter of the drum 20 and the amount of space that is desired between seals on the web 12.

In this embodiment, the seal bar 24 utilizes heat. When the seal bar 24 and the web 12 are engaged, the heat of the seal bar 24 will cause the polymeric material of the web 12 to melt, which will cause the adjacent first and second layers 14, 16 to fuse into each other to form the heat seal 26.

As can be seen in FIGS. 1 and 6, a roller 32 and a roller 34 precede and follow the seal drum 20, in order to help put tension on the web 12 in order to create a better heat seal 26.

Figure 2:
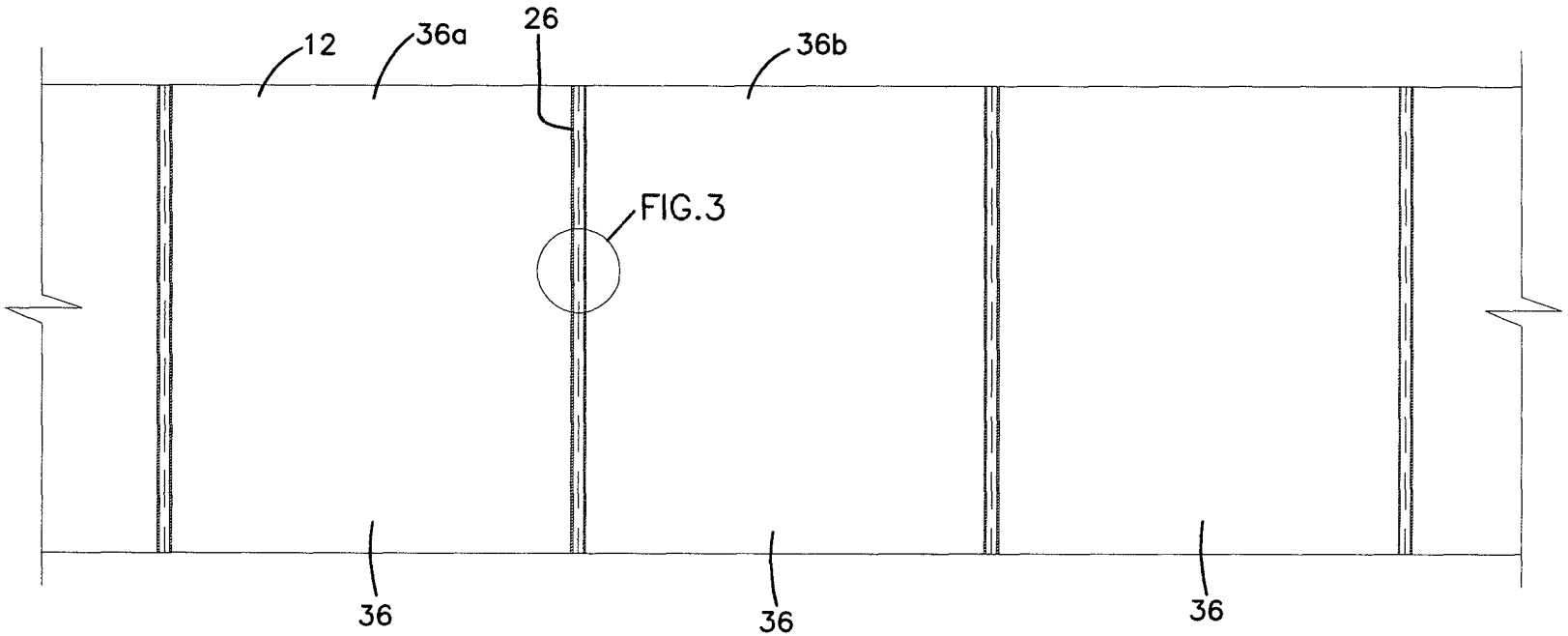
FIG. 2 is a top plan view of bags produced by the process of FIG. 1.
Figure 3:
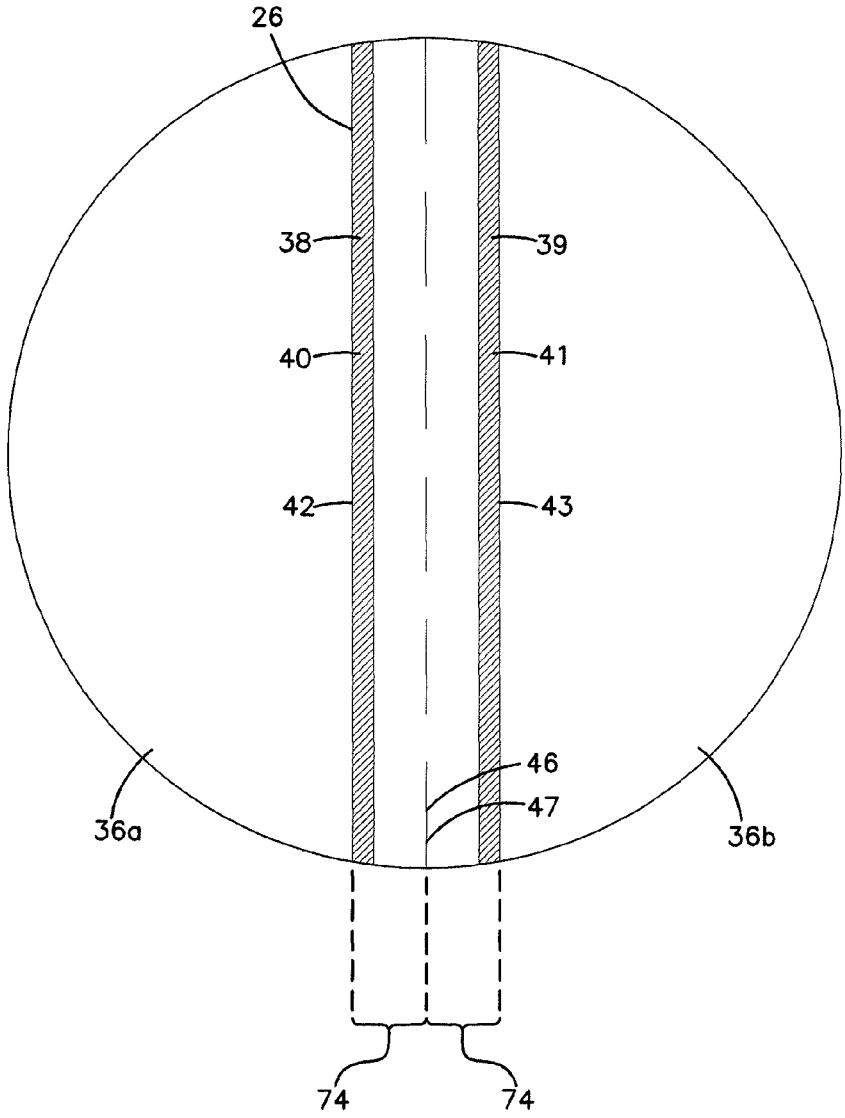
FIG. 3 is an enlarged view of the seal region and perforation line between two adjacent bags of the embodiment of FIG. 2.

In FIGS. 2 and 3, an example of one embodiment of heat seal 26 (formed from the arrangement of FIG. 1) is illustrated. In FIG. 2, individual bags 36 are connected to an adjacent bag 36 by seal 26. FIG. 3 shows an enlarged schematic view of a portion of the junction between two adjacent bags 36*a* and 36*b*. In FIG. 3, there is a pair of heat seals 26 shown at 38 and 39. The heat seals 38 and 39 each form a seal region 40, 41, each having an outside edge 42, 43. Spaced in between the seal regions 40, 41 is a perforated line 46 having an edge 47. The perforated line 46 includes a plurality of spaced cuts between both the first layer 14 and second layer 16 of the web 12. The perforated line 46 allows a person to easily separate the bag 36*b* from the bag 36*a* by applying a pull force at the perforated line 46.

While the embodiment of FIG. 3 shows two separate seal regions 40, 41, in other embodiments, this can be one continuous seal region from edge 42 to edge 43, with the perforated line 46 extending between the edges 41 and 43. The embodiment of FIGS. 2 and 3 can be used in products that are separated along their side edges, such as bags that have a drawstring or a lobe type of top.

Figure 4:
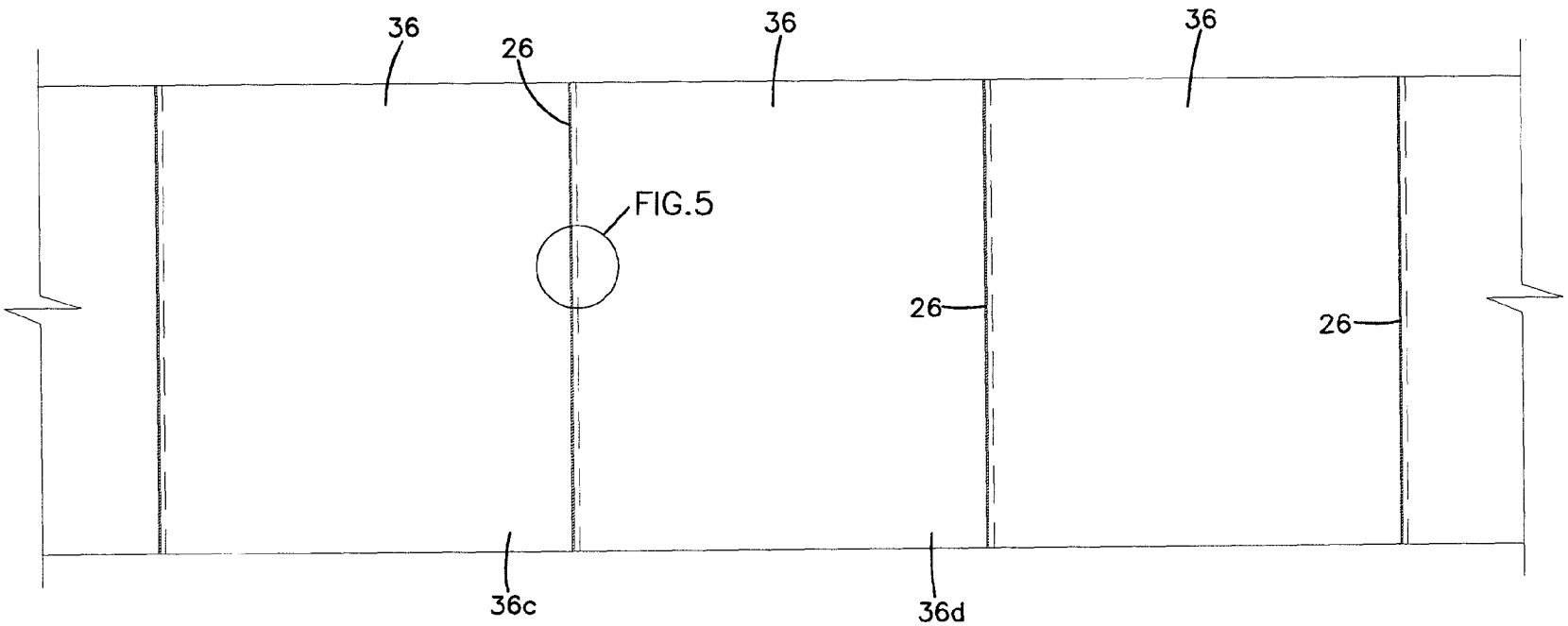
FIG. 4 is a top plan view of another embodiment of bags produced by the arrangement of FIG. 1.
Figure 5:
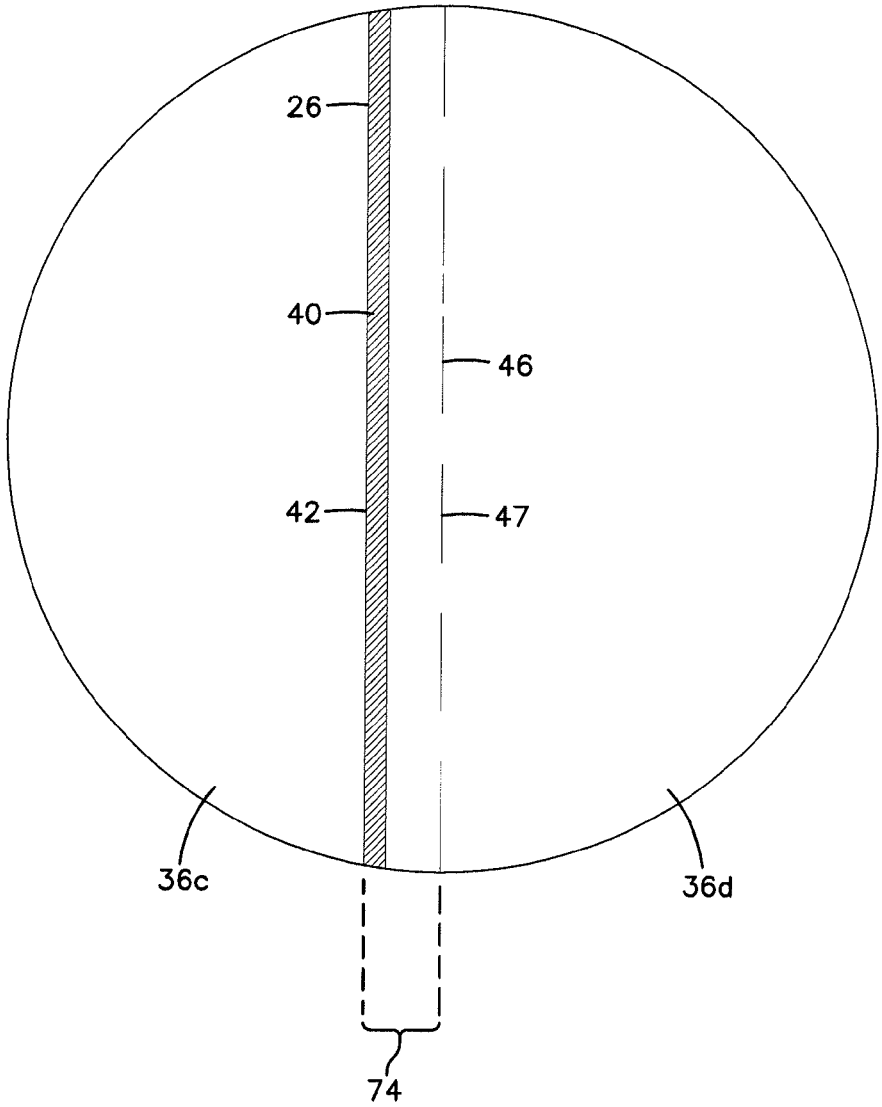
FIG. 5 is an enlarged view of the seal region and perforation line of bags of FIG. 4.

FIGS. 4 and 5 depict another embodiment of bags 36 connected by heat seal 26. In FIG. 5, two adjacent bags are shown at 36*c* and 36*d*. Heat seal 26 can be seen forming seal region 40. The seal region 40 has a seal edge 42. Spaced from and adjacent the seal region 40 is perforated line 46 having edge 47. The embodiment of FIGS. 4 and 5 would be for a standard disposer bag, in which the seal region 40 would form the bottom seal for the bag 36*c*, and the perforated line 46 would form an open mouth for the bag 36*d*.

Reference is again made to the system or arrangement 10 of FIGS. 1 and 6. A central processing unit (CPU) 50 is provided to control certain system operation, described below. The CPU 50 will preferably be part of a camera 52. It should be understood that the CPU 50 can be either a stand-alone CPU or can be integral with and part of the camera 52 itself. The camera 52 is oriented to take an image of bag 36 in the in-line process based on a triggering signal 54 received from the CPU 50. The triggering signal 54 is generated based on the seal drum 20. A seal drum encoder 56 detects a location of the seal drum 20, such as when the seal drum 20 has made engagement between seal bar 24 and the web 12. When this engagement occurs to form a heat seal 26, the electronic signal 54 is sent from the encoder 56 to the CPU 50. This signal 54 then triggers the camera 52 to take an image of the bag 36, and in particular, of the seal region 40 and perforation line 46 (FIG. 1). In FIG. 6, the camera 52 takes an image of the seal region 40 before the perforation line 46 is created.

A light source 58 is oriented adjacent to the camera 52. In preferred embodiments, the triggering signal 54 will also trigger the light source 58 to activate, while in other embodiments, the light source 58 can be a continuously lit light source 58. In preferred embodiments, the light source 58 is a strobe lamp 59. When it activates, the strobe lamp 59 emits a flash of light to allow the camera 52 to take an image that has sufficient light such that seal region 40 and perforated line 46 are viewable by the CPU 50. A strobe controller 60 receives the triggering signal 54 from the CPU 50 and causes the strobe lamp 59 to fire or activate.

A perforation knife 62 is controllable by a perforation knife motor 64 and a knife servo 66. The knife 62 is rotatable and oriented to cut the perforation line 66 into the bag 36 adjacent to the seal region 40. The perforation knife 62 is downstream of the seal drum 20. The servo drive 66 controls the knife 62 through the motor 64 by receiving signals 68, 70 from the CPU 50. In particular, the servo drive 66 is programmed, based on the sizing and line speed to activate the knife 62 with a set predetermined time (e.g., distance and pulse, which translates into time) from the time in which the seal bar 24 forms seal 26 to the time in which the seal region 40 would normally encounter the knife 62. Existing machine control indicates the position of the drum 20, and there is a phase adjustment based on the "master", which is the drum 20 in this instance. The "phase adjustment" is a time adjustment, and generates either signal 68 or signal 70. Signal 68 is a retard signal, which will slow down the servo drive 66 from activating the knife 62. Signal 70 is an advance signal to advance the servo drive 66 to activate the knife 62, both in comparison to the standard predetermined time. The signals 68 and 70 will depend upon a calculation performed by the CPU 50, which is based on the image taken by the camera 52. This is described below.

In reference now to FIGS. 3 and 5, the CPU 50 will take the image from the camera 52 and count pixels between the seal region edge 42 and edge 47 of the perforated line 46 to result in an actual pixel count 74. In FIG. 3, there are two actual pixel counts 74 illustrated. In typical implementation, only a single actual pixel count 74 will be needed, but it could be either of the areas shown in FIG. 3.

Next, the CPU 50 will calculate a pixel count error by subtracting the actual pixel count 74 from a predetermined pixel count setpoint. That is, before the process starts, the CPU 50 is programmed to have a number that is an ideal pixel count setpoint. The pixel count error is calculated by taking the actual pixel count 74 and subtracting it from this predetermined pixel count setpoint. Based on the pixel count error, the servo drive 66 is caused to either go in advance or go slower than its set programmed timing. This will be based on the polarity (positive or negative) of the pixel count error. That is, if the pixel count error is negative, the CPU 50 will output advance signal 70 to provide an advance correction signal to the servo drive 66 for the knife 62. If the pixel count error is positive, this will cause the CPU 50 to send retard signal 68 to the servo drive 66 to provide a retard correction signal to the servo drive 66. Of course, the pixel count error could be calculated by subtracting the predetermined pixel count setpoint from the actual pixel count, and the advance/retard signals would be correspondingly triggered in accordance with the polarity.

The amount of time in which the servo drive 66 either advances or retards the knife 62 is also controlled. This is based on the size of the pixel count error. The actual advance time or delay time will be proportional to the magnitude of the error. This will result in being able to closely control the distance between the perforation line 46 and the seal region 40, resulting in shorter bag skirts, reduced costs, and reduced waste. For example, the perforation line 46 will be able to be applied adjacent to the seal region 40 no greater than 3 mm. Typically, the width of the seal region 40 will be no greater than 3 mm.

In the embodiment of FIG. 6, the set-up is identical to FIG. 1 except for the location of the camera 52 and light source 58. In the FIG. 6 embodiment, the camera takes an image of the seal region 40 before the perforation line 46 is applied, and hence, the seal region 40 is devoid of a perforation line. The CPU 50 reviews the leading edge of the seal region 40 and counts pixels from the leading edge to a mechanical marker or pointer. The mechanical pointer is in the position where the perforation lines are shown in FIGS. 3 and 5. Based on the location of the seal region 40 as seen on the image as translated into a pixel count, the CPU 50 either sends retard signal 68 or advance signal 70 to the knife servo 66 to control the knife 62 in its application of the perforation line 46.

Based on the above description, a method of making a bag in a continuous in-line process comprises continuously advancing a web, and while the web is advancing sealing a portion of the first layer and second layer to result in a seal region having a seal region edge. This can include, for example, sealing layers 14 and 16 together to result in seal region having edge 42. Next, the method includes based on predetermined time from the sealing step, applying a perforation line to the web adjacent to the seal region to result in a perforated line having a perforation edge. This can include, for example, applying perforation line 46 to the web 12 adjacent to the seal region 40. The perforated line 46 will have perforated edge 47.

Next, the method includes taking an image of the seal region. This can also include taking an image of the perforated line, or alternatively, the image can be devoid of the perforated line. For example, the camera 52 can be used to take an image of the seal region 40 and perforated line 46.

Next, in embodiments in which the perforated line 46 is part of the image, the method includes using the image to count pixels between the seal region edge and perforation edge to result in an actual pixel count. In embodiments in which the image taken is devoid of the perforated line, the image is used to count pixels from the leading edge of the seal region to the mechanical pointer. This can be implemented by, for example, having the CPU 50 count pixels between seal region edge 42 and perforation edge 47, in one example, and the CPU 50 count pixels from the leading edge of the seal region edge 42 to the mechanical pointer.

Next, the method includes calculating a pixel count error by subtracting the actual pixel count from a predetermined pixel count setpoint. The CPU 50 can be used for this step. The pixel count setpoint will be preprogrammed within the CPU 50.

Next, the steps of sealing, applying a perforation line, taking an image, using the image, and calculating, are repeated and further include adjusting the predetermined time of applying a perforation line based on the pixel count error. Adjusting the predetermined time can include either advancing or retarding the application of the perforation line. For example, this can be through signals 68, 70 sent from the CPU 50 to the knife servo drive 66.

The process for making the bag can also be characterized as continuously advancing web 12, including first layer 14 on top of second layer 16 of a polymeric film along a processing line, and while the web 12 is advancing, taking an image of a first seal region (such as a first seal region 140, see FIG. 1). Next, using the image, the CPU 50 can count pixels from an edge of the first seal region 140 to another fixed point, such as a mechanical pointer (FIG. 6) or a perforation line (FIG. 1) to result in an actual pixel count. Next, the CPU can calculate a pixel count error by subtracting the pixel count from a predetermined pixel count setpoint. Finally, a perforated line (such as perforated line 246, FIG. 1) can be applied based on the pixel count error.

In this method, the step of applying the perforated line 246 includes determining the polarity of the pixel count error and advancing or retarding the step of applying a perforated line based on the polarity. The size of the advance or retard will be proportional to the magnitude of the pixel count error.

In some implementations, the step of taking an image of a first seal region includes taking an image of a first seal region and a first perforated line; the step of counting pixels includes counting pixels from the first seal region edge to an edge of the first perforation line to result in the actual pixel count; and the step of applying a perforated line to the web based on the pixel count error includes applying a second perforated line to the web upstream of the first seal region (FIG. 1).

In another embodiment, the step of taking an image of a first seal region includes taking an image of a first seal region devoid of a perforated line; the step of counting pixels includes counting pixels from a leading edge of the first seal region edge to a mechanical pointer to result in the actual pixel count; and the step of applying a perforated line to the web based on the pixel count error includes applying a perforated line to the web downstream of the first seal region (FIG. 6).

The above includes a description and examples of principles of this disclosure. Many embodiments can be made.

We claim:

1. A method of making a bag in a continuous in-line process; the method comprising:

(a) continuously advancing a web including a first layer on top of a second layer of polymeric film along a processing line, and while the web is advancing:

(i) sealing a portion of the first layer and second layer together to result in a seal region having a seal region edge;

(ii) based on a predetermined time from the sealing step, applying a perforation line to the web adjacent to the seal region to result in a perforated line having a perforation edge;

(iii) taking an image of the seal region and perforated line;

(iv) using the image, counting pixels between the seal region edge and the perforation edge to result in an actual pixel count;

(v) calculating a pixel count error by subtracting the actual pixel count from a predetermined pixel count setpoint; and (b) repeating steps (i)-(v) and adjusting the predetermined time of step (ii) based on the pixel count error.

2. A method according to claim 1 wherein the step of adjusting the predetermined time of step (ii) includes determining the polarity of the pixel count error and advancing or retarding the step of applying a perforation line based on the polarity.

3. A method according to claim 2 wherein the step of adjusting the predetermined time of step (ii) includes advancing or retarding the step of applying a perforation line based on the polarity and in proportion to a magnitude of the pixel count error.

4. A method according to claim 3 wherein the step of adjusting the predetermined time of step (ii) includes controlling a perforation knife motor with a servo drive based on the pixel count error.

5. A method according to claim 1 wherein the step of sealing further includes triggering the step of taking an image using a camera of a downstream seal region and perforated line.

6. A method according to claim 5 wherein the step of taking an image further includes activating a strobe lamp to provide light on the seal region and perforated line when the image is taken.

7. A method according to claim 6 wherein the camera includes a central processing unit; and the steps of triggering, activating a strobe lamp, counting pixels, calculating, and adjusting the predetermined time of step (ii) are each done by the central processing unit.

8. A method according to claim 1 wherein the step of sealing a portion of the first layer and second layer together is done by rotating a seal drum having at least one seal bar against the web.

9. A method according to claim 1 wherein the step of applying a perforation line to the web adjacent to the seal region includes applying the perforation line between a pair of seal regions.

10. A method according to claim 1 wherein the step of applying a perforation line to the web adjacent to the seal region includes applying the perforation line no greater than 3 mm from the seal region.

11. A method according to claim 1 wherein the step of sealing a portion of the first layer and second layer together results in a seal region having a width no greater than 3 mm.

12. A method according to claim 1 wherein the step of continuously advancing a web including a first layer on top of a second layer of polymeric film along a processing line includes advancing a continuous tube of polymeric film.

13. A process for making a bag in a continuous in-line process; the process comprising:

(a) continuously advancing a web including a first layer on top of a second layer of polymeric film along a processing line, and while the web is advancing:

(i) taking an image of a first seal region;

(ii) using the image, counting pixels from an edge of the first seal region to a fixed point to result in an actual pixel count;

(iii) calculating a pixel count error by subtracting the actual pixel count from a predetermined pixel count setpoint; and (iv) applying a perforated line to the web based on the pixel count error.

14. A method according to claim 13 wherein the step of applying a perforated line includes determining the polarity of the pixel count error and advancing or retarding the step of applying a perforated line based on the polarity.

15. A method according to claim 14 wherein the step of advancing or retarding the step of applying a perforated line based on the polarity is based on a proportion to a magnitude of the pixel count error.

16. A method according to claim 13 wherein:

(a) the step of taking an image of a first seal region includes taking an image of a first seal region and a first perforated line;

(b) the step of counting pixels includes counting pixels from the first seal region edge to an edge of the first perforation line to result in the actual pixel count; and (c) the step of applying a perforated line to the web based on the pixel count error includes applying a second perforated line to the web upstream of the first seal region.

17. A method according to claim 13 wherein:

(a) the step of taking an image of a first seal region includes taking an image of a first seal region devoid of a perforated line;

(b) the step of counting pixels includes counting pixels from a leading edge of the first seal region edge to result in the actual pixel count; and (c) the step of applying a perforated line to the web based on the pixel count error includes applying a perforated line to the web downstream of the first seal region.

* * * * *